US006296314B1

(12) United States Patent
Klein

(10) Patent No.: US 6,296,314 B1
(45) **Date of Patent: *Oct. 2, 2001**

(54) CONVERTIBLE FURNITURE UNIT

(76) Inventor: Harold Klein, 30 E. 81st St., New York, NY (US) 10028

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/058,512

(22) Filed: Apr. 10, 1998

(51) Int. Cl.[7] ..... A47C 7/00
(52) U.S. Cl. ..... 297/440.14; 297/119; 297/461
(58) Field of Search ..... 297/461, 119, 297/219.11, 440.14; 108/13

(56) References Cited

U.S. PATENT DOCUMENTS

| | | | | |
|---|---|---|---|---|
| 902,007 | | 10/1908 | Smith . | |
| 1,218,322 | | 3/1917 | Sandell . | |
| 1,850,420 | * | 3/1932 | Schuldt | 108/13 |
| 1,976,031 | * | 10/1934 | Lowenberg | 297/119 |
| 2,564,338 | | 8/1951 | McCarroll . | |
| 2,693,225 | | 11/1954 | Hinckley . | |
| 2,919,169 | * | 12/1959 | Jackson | 297/461 |
| 2,925,851 | * | 2/1960 | Weiss | 297/119 |
| 3,093,410 | | 6/1963 | Wilson . | |
| 3,143,375 | * | 8/1964 | Langbaum | 297/461 |
| 3,239,270 | | 3/1966 | Milne . | |
| 3,338,190 | * | 8/1967 | Hammond | 297/461 X |
| 3,536,359 | * | 10/1970 | Amos | 297/461 |
| 3,614,155 | * | 10/1971 | Campbell | 297/461 X |
| 3,744,845 | | 7/1973 | Sooker . | |
| 3,817,573 | | 6/1974 | Facury . | |
| 3,880,458 | | 4/1975 | Jackson . | |
| 4,159,714 | * | 7/1979 | Peterson et al. | 297/461 X |
| 4,506,927 | | 3/1985 | Lombardo . | |
| 5,440,768 | | 8/1995 | Danin . | |
| 5,531,506 | | 7/1996 | Scott . | |

FOREIGN PATENT DOCUMENTS

| | | | | |
|---|---|---|---|---|
| 1422114 | * | 1/1976 | (GB) | 297/119 |
| 2277973 | | 11/1994 | (GB) . | |

* cited by examiner

*Primary Examiner*—Peter M. Cuomo
*Assistant Examiner*—Stephen Vu
(74) *Attorney, Agent, or Firm*—Sofer & Haroun, LLP

(57) ABSTRACT

A furniture unit comprising a base unit, leg portions and a flat platform that rests on a support members within the base unit. The platform has a first and a second face, where the first face is structured to be a table surface and the second face has a cushion securely attached to it. The furniture unit may further comprise a back support unit securely attached to the base unit. The furniture unit may also comprise a pair of arm rests that are securely attached to the base unit.

15 Claims, 5 Drawing Sheets

CONVERTIBLE FURNITURE UNIT

FIELD OF THE INVENTION

This invention relates to a convertible furniture set, and more specifically to a portable convertible furniture unit that may alternately be used for a number of different functions.

BACKGROUND OF THE INVENTION

As is widely known, furniture pieces are generally designed, planned and manufactured for only accomplishing specific tasks. Thus, chairs, armchairs and banquettes are only employed for sitting, while central or lateral console tables have been specifically drawn up to be devices for supporting objects.

However, it is known from the prior art to manufacture a convertible furniture ensemble that is capable of accomplishing more than one function. For example, U.S. Pat. No. 3,093,410, issued to Forest Wilson, discloses a convertible divan ensemble, which may be used to seat two people, in addition to being convertible into a single bed. The divan of the Wilson patent has a back cushion that may be adapted to serve as part of the sleeping surface.

U.S. Pat. No. 3,744,845, issued to Harry Sooker, discloses a combination bench, stool, and plaque-table which can be used in a few different ways. The invention claimed in the Sooker patent includes means to attach the table securely to the stool support and further has means to use the table top as a decorative plaque when it is not in use as a table. The Sooker patent provides for plural height configurations.

U.S. Pat. No. 3,817,573, issued to Guilherme Facury, discloses a convertible furniture set for living rooms that consists of a few basic pieces, where all pieces are devised so as to allow utilization of the pieces in the functions of providing sitting means and providing supporting surfaces for use as a table. The Facury patent teaches the use of a loose cushion on a base unit having supporting legs, where the cushion has an upholstered face and another face covered with a rigid, flat material overlay. If the upholstered portion of cushion faces outwards the disclosed invention may be used for sitting, while if the rigid, flat material overlay faces outwards then the disclosed invention is used as a table. However, the base unit disclosed in the Facury patent is a bulky structure. Furthermore, when the flat material overlay faces outwards and the upholstered portion of the cushion is in contact with the base unit, the table assembly is unstable.

Thus, there is a need for a ready to assemble furniture kit for constructing a portable furniture unit that may alternately be used as a stool, chair or a foot rest and as a table, and where the user is further able to change the designs of the upholstery on the cushions of the furniture unit.

SUMMARY OF THE INVENTION

In accordance with one embodiment of the present invention, a furniture unit is provided that comprises a base unit, four legs and a flat platform that rests within the base unit. The platform has a first and a second face, where the first face is structured as a table surface and the second face has a cushion securely attached to it.

In accordance with another embodiment of the present invention, the furniture unit may further comprise a back support unit that is securely attached to the base unit.

In accordance with another embodiment of the present invention, the furniture unit may also comprise a pair of arm rests that are securely attached to the base unit.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings which:

DETAILED DESCRIPTION OF THE DRAWINGS

Figure 1A:
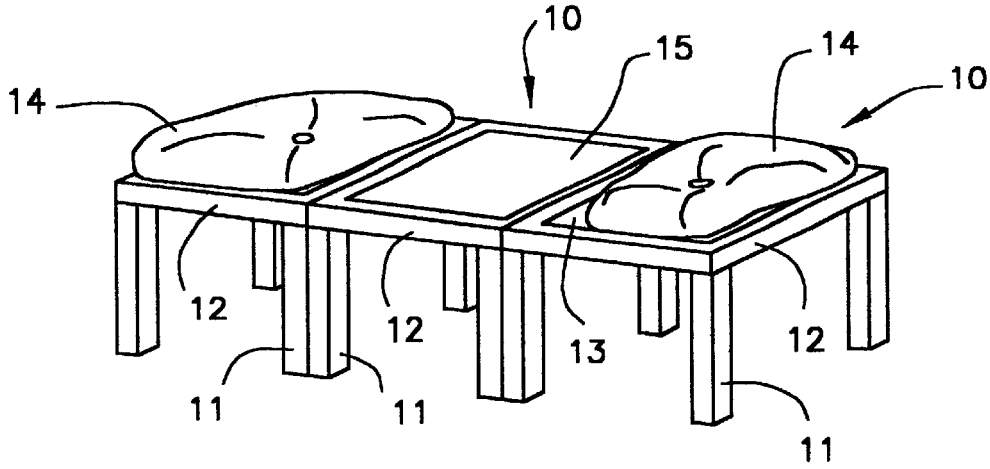
FIGS. 1(*a*)–1(*c*) illustrate a plurality of arrangements employing a furniture unit in accordance with one embodiment of the invention.
Figure 1B:
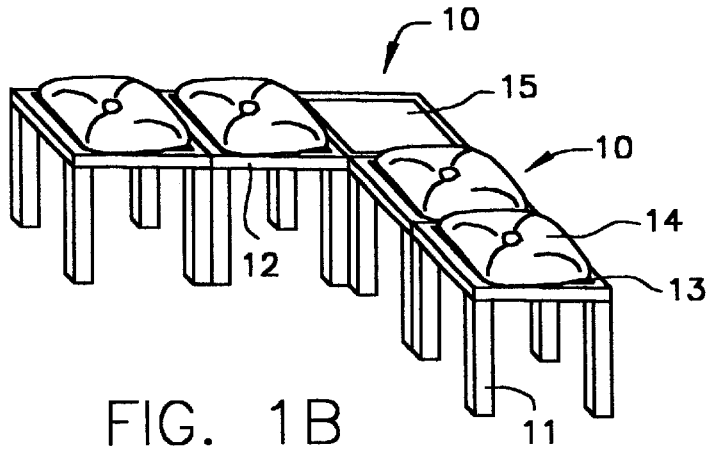
Figure 1C:
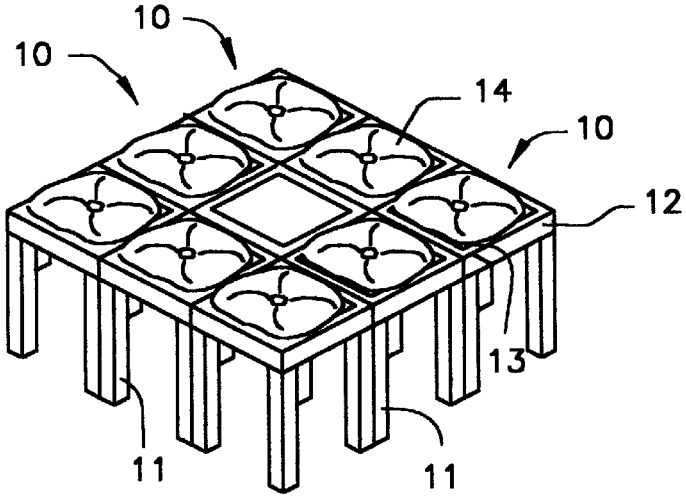
Figure 7:
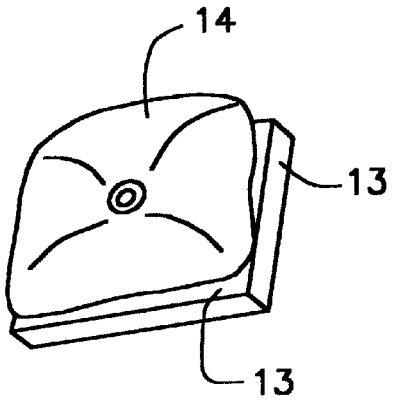
FIG. 7 illustrates the top view of the cushion fixedly attached on the flat platform shown in FIG. 5.

Referring initially to FIGS. 1(*a*)–1(*c*), Fig 1(*a*) shows a furniture arrangement formed by fixedly placing adjacent to each other three pieces of a convertible furniture unit 10, in accordance with one embodiment of the invention. Each furniture unit 10 consists of four legs 11 that are securely mounted on to a base frame 12. Base frame 12 houses a flat platform 13. Platform 13 has two faces, where one of the two faces has a table-like surface 15, and the other face of platform 13 securely attaches to a padded cushion 14. Thus, the furniture unit can be used as a table by exposing the table-like surface 15 outwards (FIG. 8) or as a chair or stool when padded cushion 14 is exposed outwards (FIG. 7). Platform 13 is securely placed in base frame 12 and may be removed at the user's discretion, such that user may alternately use furniture unit 10 as a table or chair by merely removing platform 13 from base unit 12 and turning platform 13 around so that the other side of platform 13 is exposed outwards. FIG. 1(*b*) and FIG. 1(*c*) show other possible arrangements that employ furniture units 10.

Figure 2:
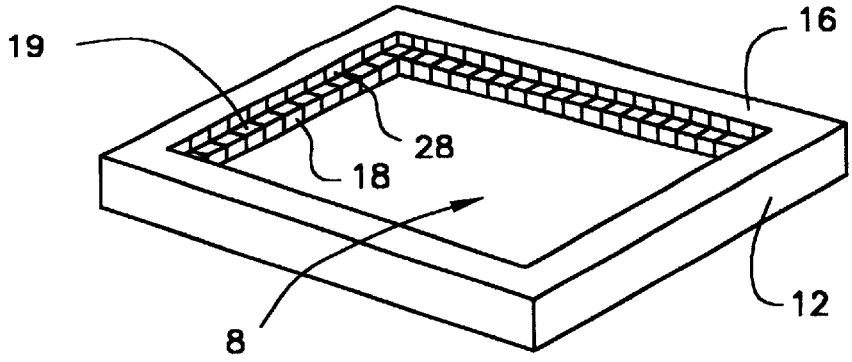
FIG. 2 illustrates the top view of the base portion of a furniture unit in accordance with one embodiment of the present invention.

As illustrated in FIG. 2, the four sides of base frame 12 define a hollow portion 8, that is configured to receive platform 13. Base frame 12 comprises of a top portion 28 and a lower portion 18. Lower portion 18 comprises a support means, such as a support edge 19 or other types of support brackets, upon which platform 13 rests when it is placed in base frame 12. In another embodiment of the present invention, lower portion 18 may be provided with support members, such as pins protruding from the side walls, brackets, or flange panel, etc.

Top portion 28 is dimensioned such that platform 13 may be fixedly secured in hollow portion 8 surrounded by the internal walls of top portion 28 in base frame 12. The height of the wall formed between support edge 19 and top portion 16 of frame 12 is substantially equal to the height of platform 13 to ensure that surface 15 of platform 13 (FIG. 8) forms a uniform plane with top surface 16. It is preferable that top surface 16 of base frame 12 be provided with the same design and color as surface 15 of platform 13 so that when surface 15 of platform 13 faces outwards, its design and color blends in with base frame 12.

To ensure a secure placement of platform 13 in base frame 12 when furniture unit 10 is being used as a table, cushion 14 (FIG. 7) is constructed slightly smaller than the inner circumference of lower portion 28 within base frame 12. Thus, cushion 14 does not interfere with the inner walls of lower portion 18 when it faces inwards.

Figure 3:
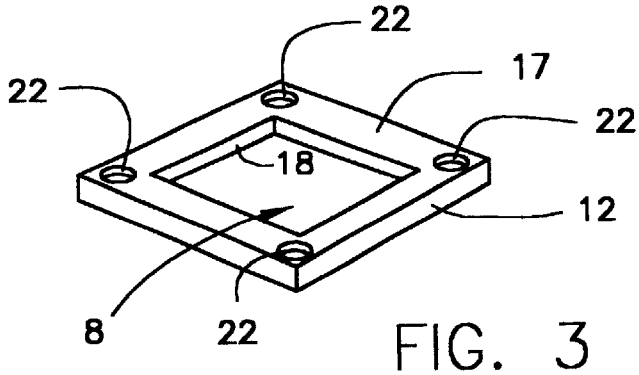
FIG. 3 illustrates the bottom view of the base portion illustrated in FIG. 2.
Figure 4:
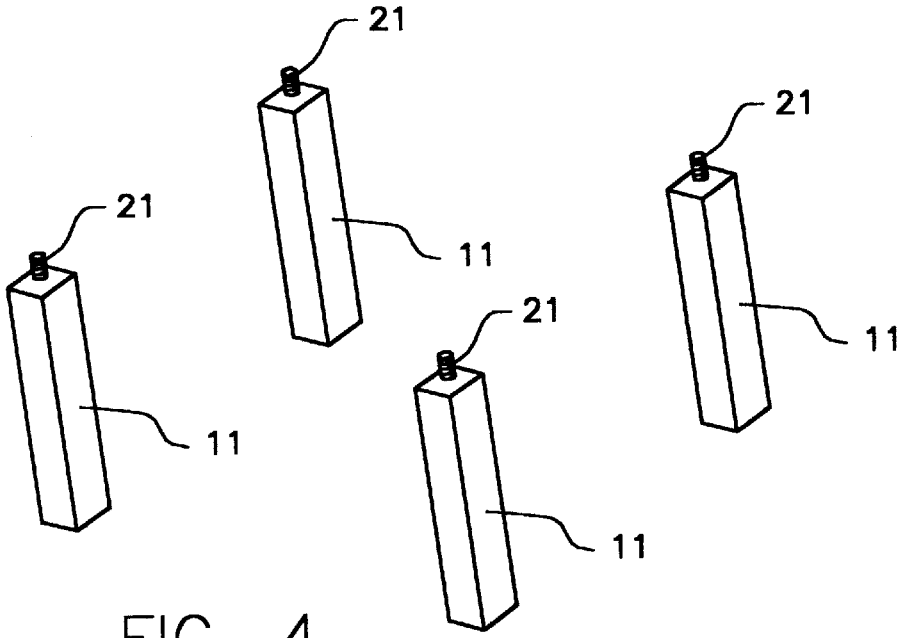
FIG. 4 illustrates the front view of the leg portions for use with the base portion illustrated in FIGS. 2–3.
Figure 5:
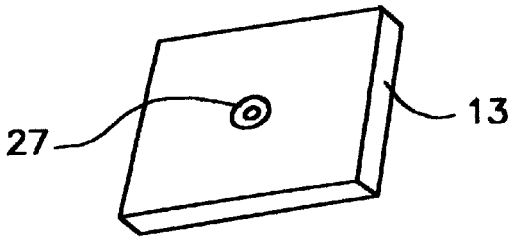
FIG. 5 illustrates the top view of a flat platform for use in the base portion shown in FIG. 2.
Figure 6:
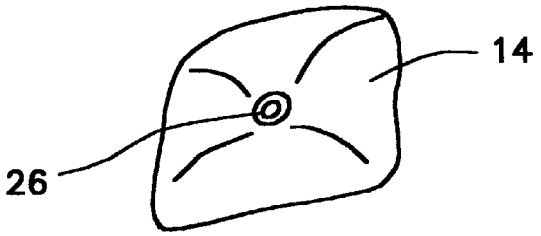
FIG. 6 illustrates the top view of the cushion for use with the flat platform illustrated in FIG. 5.

FIG. 3 shows bottom surface 17 of base frame 12. In one embodiment, bottom surface 17 is wider than the top surface 16 (FIG. 2). Bottom surface 17 comprises of four apertures 22. Each aperture 22 has grooves built inside them to fastenably secure the protruding fastening means 21 (FIG. 4) from leg 11.

It is preferable that the protruding fastening means 21 of leg 11 be a bolt, so that leg 11 may be secured to base frame 12 by simply twisting the leg into one of the apertures 22 without the need of having to use tools, such as hammers and screw drivers. However, alternate fastening means may also be used to practice this invention. Thus, fastening means 21 can also be a screw or a push-fit securing means. As is known from the prior art, a push-fit securing means comprises a receptor means having a body portion with fixing means. The receptor means may be fixed in aperture 22 of the base unit 12 and an adjustable connector means is provided in leg 11 of furniture unit 10. The adjustable connector means has engagement portions, one of which is inserted into the receptor means in a push-fit manner.

Referring now to FIGS. 5–8, FIG. 5 shows the top portion of platform 13 upon which cushion 14 (FIG. 6) is securely attached. Towards this end, platform 13 is provided with fastening means 27. Fastening means 27 may be made of hook and loop type fasteners, such as Velcro. Although it is preferable to use a hook and loop fastener as fastening means 27, a variety of different fastening mechanisms, such as press buttons, may alternatively be used. To ensure that cushion 14 is securely attached to platform 13, cushion 14 possesses a reciprocal fastening mechanism 26 that corresponds to fastening means 27 on platform 13. Upon being securely fastened, cushion 14 functions akin to a sitting portion of an upholstered chair or stool.

Cushion 14 may be obtained in a variety of different designs and styles. Since cushion 14 is attached to platform 13 by detachable fastening means 27 and 26, it is possible to change the design of the sitting portion by merely replacing the cushion 14. It is possible to obtain cushions made from plastic for outdoor use or made from cloth for indoor use. According to the present invention, cushion 14 comes in a wide variety of shapes, designs and sizes to conform to a wide variety of tastes. This feature is advantageous in that the user may use different cushion 14 for different occasions or even different moods.

Figure 8:
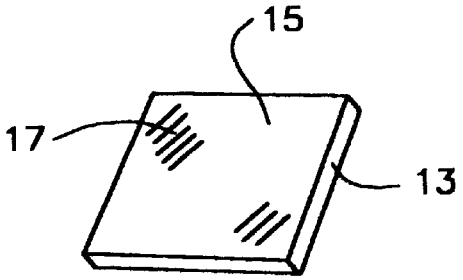
FIG. 8 illustrates the top view of the reverse side of the platform illustrated in FIG. 5.

Referring to FIG. 8, surface 15 of platform 13 may be provided in a variety of designs 17, such as a Chess board, Monopoly board, Checker board, backgammon etc. Thus, when surface 15 of platform 13 is exposed outwards, furniture unit 10 may be used as one of these board games. A user may purchase several furniture units 10 with various board games. When a board game is desired, the corresponding surface is turned upside and the remaining units may serve as chairs for a group of players. In accordance with this embodiment of the insertion considerable storage space may be served for storing board games.

Figure 9:
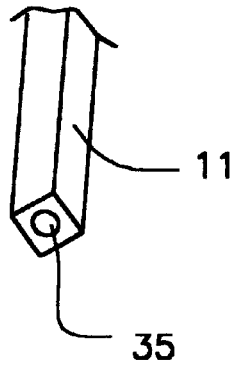
FIG. 9 illustrates the bottom portion of the leg for use in the furniture unit shown in FIG. 1.

Leg 11 for use in furniture unit 10 is shown in more detail in FIG. 9. Preferably, leg 11 has a rubber stub 35 at its bottom portion to generate friction between the furniture unit 10 and the floor. While it is beneficial to provide rubber stub 35 for each leg 11, the presence of rubber stub 35 is not necessary to practice this invention. According to the present invention, leg 11 comes in a number of different lengths. Thus, the user may be able to obtain long legs if he wishes to use furniture unit 10 as a stool in a bar, while he may obtain shorter legs if furniture unit 10 is to be used as a foot rest.

Figure 10:
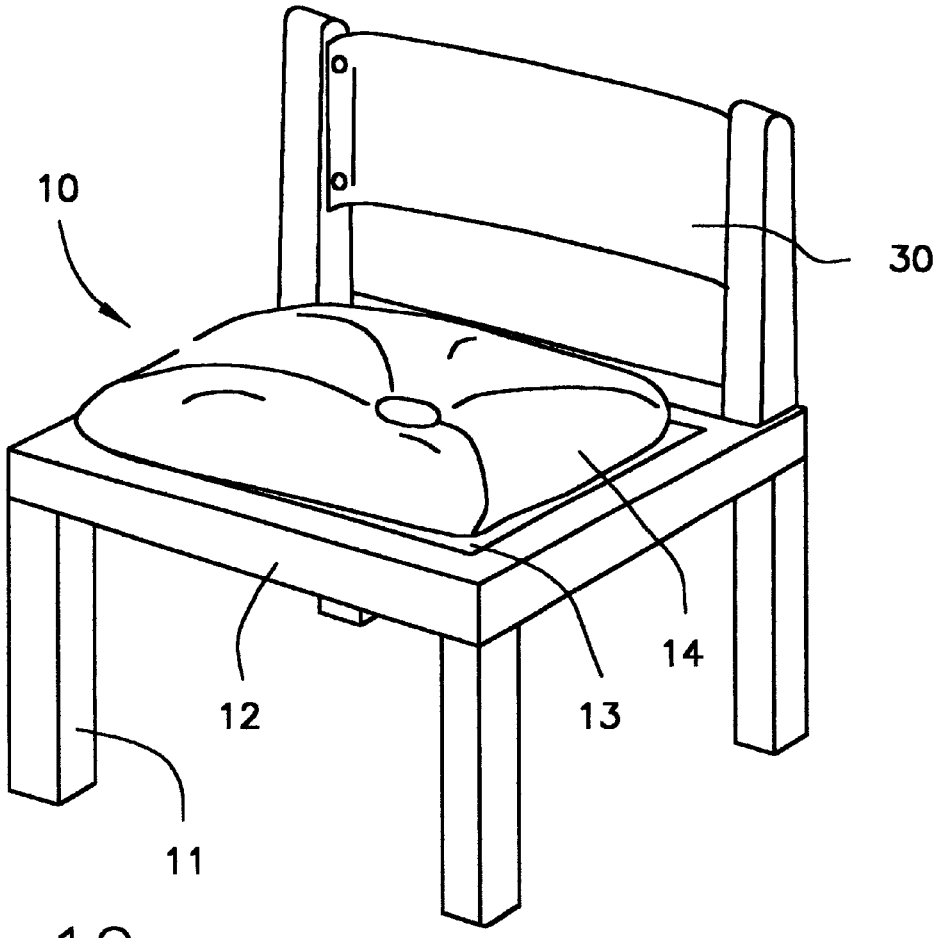
FIG. 10 illustrates another embodiment of the furniture unit with a back support.

FIG. 10 shows another embodiment of furniture unit 10 that utilizes a back support 30. While it is possible to practice the present invention without back support 30, the use of back support 30 allows the user to further utilize the present invention as a couch. In this embodiment, the invention consists of a base unit 12 that fixedly holds flat platform 13, and is mounted on four or more legs 11. Platform 13 has cushion 14 securely fastened on to it.

Figure 11:
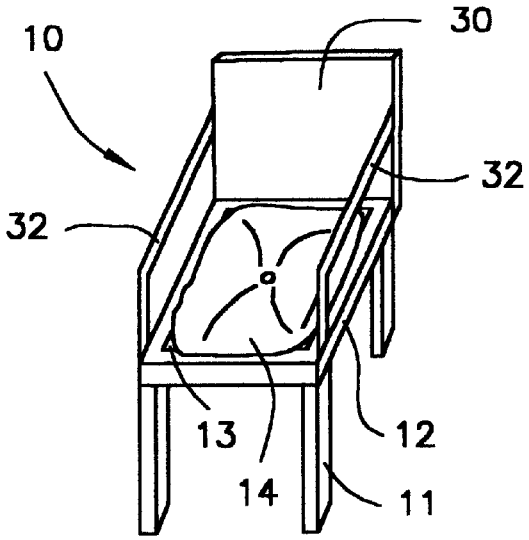
FIG. 11 illustrates another embodiment of the furniture unit with a back support and a pair of arm rests.

FIG. 11 shows another embodiment of furniture unit 10 that utilizes a back support 30 and a pair of arm rests 32 extending from base unit 12. Even though back support 30 and arm rests 32 further allow the user to practice the present invention as a comfortable sofa, it is possible to practice the present invention without the presence of back support 30 or arm rests 32. It is possible to arrange a plurality of furniture unit 10 to construct a multi-person sofa by merely placing furniture unit 10 next to another, and removing arm rest 32 from the middle.

Back unit 30 and arm rests 32 are mounted on to base frame 12 by fastening means, such as a screw, bolt or a push-fit securing means. As is known from the prior art, a push-fit securing means comprises a receptor means having a body portion with fixing means. The receptor means is fixable in aperture 22 in the base unit 12 and an adjustable connector means provided in back support 30 or arm rest 32 of furniture unit 10. The adjustable connector means has two engagement portions, one of which is inserted into the receptor means in a push-fit manner.

Figure 12:
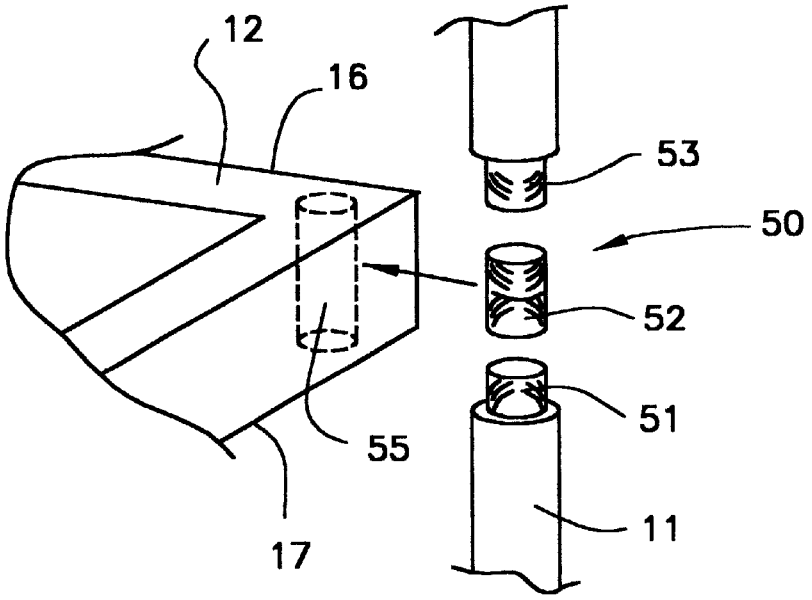
FIG. 12 illustrates a fastening means for use according to one embodiment of the present invention.

FIG. 12 shows another embodiment of fastening means 50 for fixedly securing leg 11 to base frame 12, and for fixedly securing back support 30 to base frame 12. Fastening means 50 comprises a hollow body or pipe 52 that is fixedly housed in aperture 55 of base frame 12, extending from the bottom portion 17 to top portion 16 of base frame 12. Pipe 52 may be provided with grooves or a threaded surface on its outer surface to correspond with grooves provided in aperture 55, which ensures a stronger securement of pipe 52. Leg 11 is provided with a protruding rod 51 on its top portion, which is inserted into aperture 55 from the bottom portion 17 of the base frame 12, such that it is securely received in pipe 52. Back support 30 may also be provided with a protruding rod 53 on its bottom portion, which is inserted into aperture 55 from the top portion 16 of the base frame 12, such that it is securely received in pipe 52. It is preferable that protruding rod 52 and protruding rod 53 be metallic to ensure that the fastening means are strong enough to withstand the force created by a sitting person. However, the scope of this invention is not limited by the material that the protruding rod comprises of, and thus the protruding rods could be constructed from others materials, such as solid wood, hard plastic, etc.

While it is preferable that furniture unit 10 be made from wood to keep the weight of each individual unit 10 to the minimum, the scope of this invention is not limited by its building materials. Consequently, it is possible to practice the present invention by constructing the furniture unit 10 from other materials, such as copper, steel, cast iron, etc. As is obvious from the above description, the present invention has the advantage that the furniture unit 10 comes ready to assemble. The user can assemble the furniture unit 10 at his own convenience, and disassemble furniture unit 10 be merely unscrewing the joined pieces. Thus, the present invention allows the user to easily disassemble and store the furniture unit 10 when it is not needed. The convenience in disassembling furniture unit 10 allows the user to carry the unassembled furniture unit outdoors and assemble it once he is ready to use the furniture unit as a sitting means or a table, depending on his choice.

What is claimed is:

1. A furniture unit comprising:

a base frame, said base frame having a top portion and a lower portion that has a support member, said base frame in conjunction with said support member defining a hollow portion;

a plurality of legs, said legs mounted to said base frame;

a detachable flat platform having top and bottom surfaces, two side surfaces, and a uniform thickness, said platform securely resting on said support member of said lower portion of said base frame, such that when one of said top and bottom surfaces frictionally contacts said support member, the other surface is horizontally level with said top portion of said base frame and the thickness of said platform is equal to a distance between the support member and said top portion of said base frame; and a cushion securely attached to one of said surfaces of said platform, said cushion sized to fit within said hollow portion when the thickness of said cushion is greater than the combined height of said top and lower portion of said base frame, so that said cushion can remain attached to said platform when said furniture unit is in a table configuration.

2. The furniture unit as claimed in claim 1, wherein said lower portion is wider than said top portion of said base frame.

3. The furniture unit as claimed in claim 1, wherein said support member has a supporting edge shape.

4. The furniture unit as claimed in claim 1, wherein said platform and said cushion comprise fastening means for fixedly attaching said cushion to said platform.

5. The furniture unit as claimed in claim 1, wherein said legs further comprise a bottom portion on which rubber stubs are disposed.

6. The furniture unit as claimed in claim 1, wherein said base frame has four apertures for fixedly engaging fastening means on said legs.

7. The furniture unit as claimed in claim 6, wherein said fastening means is a bolt.

8. The furniture unit as claimed in claim 6, wherein said apertures have grooves built into them.

9. The furniture unit as claimed in claim 1, wherein a design of said second surface of said platform is selected from a group consisting of a chessboard, a backgammon board, or a monopoly board.

10. The furniture unit as claimed in claim 1, wherein the furniture unit is made from wooden material.

11. The furniture unit as claimed in claim 1, wherein said cushion has a plastic covering.

12. The furniture unit as claimed in claim 1, wherein said cushion has an upholstery made of a cloth.

13. The furniture unit as claimed in claim 1, wherein each of said legs has a protruding rod extending from a top portion of each said leg, said base frame comprises an aperture extending from the top portion to lower portion of said base unit, said leg being securely fastened into said base frame by a fastening means, said fastening means comprising said protruding rod and said aperture, said protruding rod being fixedly inserted in said aperture.

14. The furniture unit as claimed in claim 1, further comprising a back support unit, said back unit securely attached to said base frame.

15. The furniture unit as claimed in claim 1, further comprising a pair of arm rests, said arm rests securely attached to said base frame.

* * * * *